US008714137B2

(12) United States Patent
Doering et al.

(10) Patent No.: US 8,714,137 B2
(45) Date of Patent: May 6, 2014

(54) CARBURETTOR UNIT FOR MOTORIZED EQUIPMENT

(75) Inventors: Manfred Doering, Hamburg (DE); Torsten Haussner, Geesthacht (DE)

(73) Assignee: DOLMAR GmbH, Hamburg (DE)

( * ) Notice: Subject to any disclaimer, the term of this patent is extended or adjusted under 35 U.S.C. 154(b) by 1203 days.

(21) Appl. No.: 12/591,448

(22) Filed: Nov. 19, 2009

(65) Prior Publication Data

US 2010/0180861 A1 Jul. 22, 2010

(30) Foreign Application Priority Data

Jan. 22, 2009 (DE) ..... 20 2009 000 831 U

(51) Int. Cl.
*F02D 9/08* (2006.01)
*F02D 41/06* (2006.01)
*F02M 1/00* (2006.01)

(52) U.S. Cl.
USPC ..... 123/337; 123/179.18

(58) Field of Classification Search
USPC ..... 123/179.18, 337, 185.1, 185.5, 336, 123/400, 442; 261/52, 64.1, 64.6
See application file for complete search history.

(56) References Cited

U.S. PATENT DOCUMENTS

| | | | | |
|---|---|---|---|---|
| 2,572,169 | A * | 10/1951 | Mallory | 261/52 |
| 5,500,159 | A * | 3/1996 | Martinsson | 261/52 |
| 5,927,241 | A * | 7/1999 | Dahlberg et al. | 123/179.5 |
| 6,000,683 | A * | 12/1999 | Van Allen | 261/52 |
| 6,202,989 | B1 * | 3/2001 | Pattullo | 261/52 |
| 6,439,547 | B1 * | 8/2002 | King et al. | 261/52 |
| 6,454,245 | B2 * | 9/2002 | Kobayashi | 261/52 |
| 6,494,439 | B1 * | 12/2002 | Collins | 261/52 |
| 6,641,118 | B2 * | 11/2003 | Schliemann | 261/52 |
| 7,404,546 | B2 * | 7/2008 | Prager et al. | 261/52 |
| 7,431,271 | B2 * | 10/2008 | Gantert et al. | 261/52 |
| 7,699,294 | B2 * | 4/2010 | Pattullo | 261/52 |
| 8,061,322 | B2 * | 11/2011 | King et al. | 123/179.18 |
| 8,240,639 | B2 * | 8/2012 | Roth | 261/52 |
| 8,356,805 | B2 * | 1/2013 | Hanssler et al. | 261/52 |
| 2002/0121710 | A1 * | 9/2002 | King et al. | 261/52 |

FOREIGN PATENT DOCUMENTS

| | | |
|---|---|---|
| DE | 91 06 194 U1 | 9/1991 |
| DE | 195 18 956 A1 | 12/1995 |
| DE | 197 06 654 A1 | 8/1997 |
| DE | 10 2004 063 197 A1 | 7/2006 |

OTHER PUBLICATIONS

German Search Report issued for German Application No. 20 2009 000 831.2 on May 7, 2009 (with translation).

* cited by examiner

*Primary Examiner* — Stephen K Cronin
*Assistant Examiner* — Sizo Vilakazi
(74) *Attorney, Agent, or Firm* — Oliff PLC

(57) ABSTRACT

In order to provide a carburettor unit for motorized equipment, in particular hand-operated motorized equipment such as a chain saw, a trimmer, a lawn-cutting appliance, a foliage clearing appliance or suchlike, having a housing , in which a throttle valve and a choke valve are held so as to be movable respectively between a closed position and an open position, which overcomes the disadvantages of the prior art and in which an incorrect position between the throttle valve and the choke valve is avoided, it is proposed that a locking element is provided, which is adjustable through the movement of the throttle valve and cooperates with the choke valve such that a movement of the choke valve into the closed position is locked when the motorized equipment is set in operation.

7 Claims, 3 Drawing Sheets

CARBURETTOR UNIT FOR MOTORIZED EQUIPMENT

Figure 1:
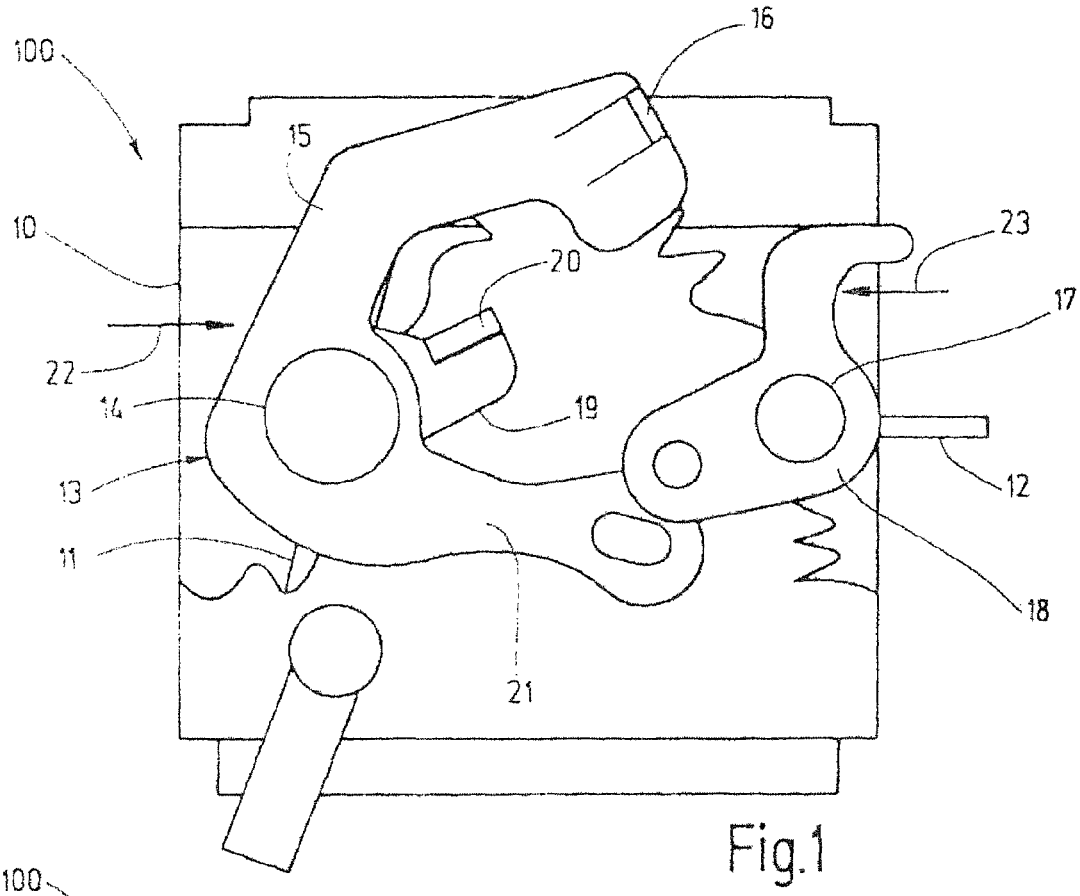

The present invention relates to a carburettor unit for motorized equipment, which is embodied in particular as hand-operated motorized equipment and can relate to a chain saw, a trimmer, a lawn-cutting appliance, foliage clearing appliance or suchlike. The carburettor unit is formed substantially by a housing in which a throttle valve and a choke valve are held so as to be movable respectively between a closed position and an open position.

Carburettor units of such motorized equipment serve for the preparation of a mixture of fuel and air, with the mixture ratio alongside the supplied amount of the mixture of fuel and air determining the operating point of the motorized equipment. If the motorized equipment has not yet reached the optimum operating temperature, then the mixture ratio is to be further adapted to the temperature of the motorized equipment. When starting motorized equipment, the mixture must be enriched, in order to set the motor in operation in particular in a cold state. Carburettor units of the type of interest here operate with an underpressure which occurs through a constriction of flow of the air which is drawn in, wherein through the underpressure, without a canal constriction in the vicinity of the throttle valve, fuel is drawn in which admixes itself with the drawn in air.

For the cold start of motorized equipment, the choke valve must be closed, so that a high draw-in underpressure occurs in the carburettor. Thereby, a large amount of fuel is drawn out from all admeasurement bores, which serves for a strong enrichment of the small amount of air which is drawn in. With this strongly enriched mixture, the motor is able to start. After a few revolutions, however, the drawn-in amount of air is too low compared with the amount of fuel, and the motor goes out again, with an amount of fuel condensing on the inner walls of the crankcase.

Through the half-gas position which is subsequently used, distinctly more air is supplied to the motor again, compared with the amount of fuel, which leads to the starting of the motor. The size of the opening of the throttle valve in the half-gas position defines the motor rotation speed here.

The half-gas position is used, as described above, on a cold start. With a start of the warm motor, it can be necessary to likewise use the half-gas position when the amount of fuel in the crankcase is so great that the amount of air which flows past the throttle valve in the idling position is not sufficient for an optimum mixture composition for starting.

The prior art with automatic half-gas here is that the half-gas position is reached by the choke valve being closed (automatic engagement of half-gas) and opened again. A starting attempt only then takes place.

It is therefore desirable that at the start of the motorized equipment, the gas lever can be arrested in the half-gas position, in order to carry out a starting process with a closed choke valve. In operation or respectively after completion of the starting process with cold motorized equipment, however, it should not be possible to arrest the gas lever in the half-gas position, whilst the choke valve remains in the closed position.

In a cold start, the carburettor unit of the motorized equipment is set in a half-gas position. The half-gas can be differentiated between an automatic half-gas and a conventional half-gas. In conventional half-gas, the half-gas position is engaged for starting the motorized equipment by the full gas button being actuated and this then being prevented, by the engagement of additional form-fitting components, from swinging back into the initial position after releasing, but rather that it engages in a predefined half-gas position. With the next full gas position, this form fit disengages, so that the throttle valve, after releasing, swings back again into the original position, which is usually determined by idling. The result of this is that for a cold start, the choke valve must be closed, with the half-gas position additionally being engaged.

An automatic half-gas, on the other hand, has a lever device which is in operative connection with the choke valve without additional actuation of the engagement components. Here, through lever elements on the carburettor unit and if applicable further levers in the intake region, on closing of the choke valve the throttle valve is swung simultaneously in a defined manner into its half-gas position, which is secured by the lever elements. With a subsequent full-gas actuation, the lever elements disengage here and the throttle valve can be swung back again into the original position after releasing of the full gas actuation. Here, for a cold start, only the choke valve has to be closed, which at the same time leads to a half-gas position of the throttle valve.

From DE 10 2004 063 197 A1 a carburettor unit for motorized equipment is known, which is formed by a housing in which a throttle valve and a choke valve are held so as to be movable respectively between a closed position and an open position. The choke valve is connected with a start lever, with the start lever being locked in its position of rest, whereby an inadvertent actuation of the setting of the choke valve is avoided. With the throttle valve coupled to the position of the choke valve, an increased initial rotation speed is also avoided. Before an actuation of the valve arrangement, firstly an unlocking movement of the start lever is necessary. Its unlocking direction, dependent on the actuating direction, requires a deliberate unlocking process, followed by a likewise deliberate actuation for setting the carburettor unit into a start configuration.

An inadvertent actuation of the valve arrangement is indeed prevented by the locking, but the choke valve can continue to be closed, independently of the position of the throttle valve, whereby an increased admixing of fuel is made possible. Thereby, a high degree of security against operating errors is indeed provided, but it is basically not avoided that a closing of the choke valve is made possible only uniquely for the case of the cold start. After the cold start, the choke valve can nevertheless be transferred into its closed position.

It is therefore the object of the present invention to provide a carburettor unit for motorized equipment, which overcomes the disadvantages of the above-mentioned prior art and in which a defective position between the throttle valve and the choke valve is avoided.

This problem is solved proceeding from a carburettor unit for motorized equipment according to the introductory clause of claim 1 in connection with the characterizing features. Advantageous further developments of the invention are indicated in the dependent claims.

The invention includes the technical teaching that a locking element is provided, which is adjustable by the movement of the throttle valve and cooperates with the choke valve such that a movement of the choke valve into the closed position is locked when the motorized equipment is set in motion. Through the arrangement according to the invention of a locking element on the carburettor unit, a mechanical locking arrangement is provided which prevents a subsequent faulty operation of the choke valve by a user. The operative connection between the locking element and the choke valve is embodied such that the choke valve can only be moved into the open position and a transfer of the choke valve into the closed position is prevented. According to the invention, the locking element is articulated by the movement of the throttle valve, so that the locking element serves as operative connection between the throttle valve and the choke valve. This kinematic operative connection of the throttle valve, the locking element and the choke valve is embodied such that the choke valve assumes a permissible position relative to the throttle valve at every operating point of the motorized equipment.

If, for a cold start, the choke valve is moved through for example 75° anticlockwise, in order to close the choke valve, then the choke valve lever fixed on the choke valve shaft is likewise co-rotated. Both in the case of a conventional half-gas and also in an automatic half-gas, the half-gas position of the throttle valve can now be set. The locking element has no effect here on the choke valve lever, and the choke valve can be moved freely. If the throttle valve was set into the half-gas position for a starting process, the choke valve can be rotated through approx. 75° clockwise, so that it is completely open with respect to the cold start position. The locking element is now swung into the locking position, but owing to the embodiment of the locking element, embodied as a lever element, can not lock the choke valve in this position. The result of this is that with conventional half-gas, the sequence of closing the choke valve and subsequently the engaging of the half-gas must be adhered to, in order to start the motorized equipment.

Advantageously, a throttle valve shaft is present, via which the throttle valve is held inside the housing so as to be rotatable between the closed position and the open position, with the locking element being held rotatably outside the housing on the throttle valve shaft. The throttle valve is held on the section on the throttle valve shaft which extends through the housing of the carburettor unit. The throttle valve shaft projects beyond a section on the end side out from the housing of the carburettor unit, so that the locking element is held on this section so as to be movable rotatably. Alternatively, the possibility exists to provide a bearing pin on the housing of the carburettor unit or on one of the modification parts, on which the lever-like locking element can be held so as to be movable rotatably.

Preferably, the locking element has an actuating arm, via which it is movable rotatably by the throttle valve lever. The locking element can have a restoring arm, angularly offset adjacent to the actuating arm, which can cooperate with an articulation element such that the locking element, on switching off of the motorized equipment, is able to be swivelled back again into a position releasing the choke valve.

According to an advantageous embodiment, the locking element is produced from a sheet metal material. Stamping and bending methods can be used for processing the sheet metal material, so that the sheet metal material firstly extends in a main sheet metal plane and individual functional regions of the locking element project out from the main sheet metal plane by partial bending of the sheet metal material. For example, the locking element can have an actuating angle projecting out from the main sheet metal plane, via which the locking element cooperates in a locking manner with the choke valve.

Additionally, a choke valve shaft is provided, via which the choke valve is held in the housing so as to be rotatable between the closed position and the open position. On the section of the choke valve shaft which extends at least partially out from the housing of the carburettor unit, a choke valve lever can be placed and be held on the choke valve shaft so as to be locked against relative rotation with the choke valve. The operative connection between the actuating angle of the locking element and the choke valve takes place via the choke valve lever. The choke valve lever extends in turn in a main sheet metal plane which is arranged offset to the main sheet metal plane of the locking element externally on the carburettor unit. Through the actuating angle, the section of the locking element projects into the main sheet metal plane of the choke valve lever, and can consequently actuate it.

In the operation of the motorized equipment, the locking element has a rotation position in which the actuating angle is swung into the rotation range of the choke valve lever such that a rotary movement of the choke valve from the open position into the closed position is prevented. The operation of the motorized equipment means an operating point which corresponds at least to half-gas and in particular to the full gas operating point. The throttle valve is opened for the operation of the motorized equipment so such a wide extent that the locking element is rotated by the actuating angle of the throttle valve lever into the locking position. The locking position is, however, not reached when the throttle valve is only slightly opened.

The throttle valve and the throttle valve lever have an angle with respect to each other, in relation to the shared rotation axis about the throttle valve shaft, which is determined such that the throttle valve lever turns the locking element into the position locking the choke valve when the throttle valve is turned in the direction towards the open position. Furthermore, it is necessary that the choke valve and the choke valve lever form an angle in relation to the shared rotation axis about the choke valve shaft, which is determined such that the choke valve lever is locked by the locking element when the choke valve is turned in the direction towards the open position.

Through the arrangement of the choke valve lever, the locking element and the throttle valve lever according to the invention, it is achieved that after the starting of the motor, the choke valve lever can only be moved again in the closed direction, when previously through the switching off of the motorized equipment the locking element has been swung out from the locking position and hence the choke valve lever is freely movable. An inadvertent closing of the choke valve during the operating of the motorized equipment is therefore ruled out, because after the first actuation of the full gas button, the locking element locks the choke valve movement anticlockwise.

To return the locking element, an articulation element can be provided, by which the locking element is able to be swivelled again into a position releasing the choke valve lever when the motorized equipment is switched off. The articulation of the locking element by the articulation element can take place via a restoring arm which is a component of the locking element and which cooperates with the articulation rod. Inside the restoring arm, an elongated hole can be provided, so that it is positioned by the throttle valve lever, with no movement of the linkage to the OFF switch on the motorized equipment.

Figure 2:
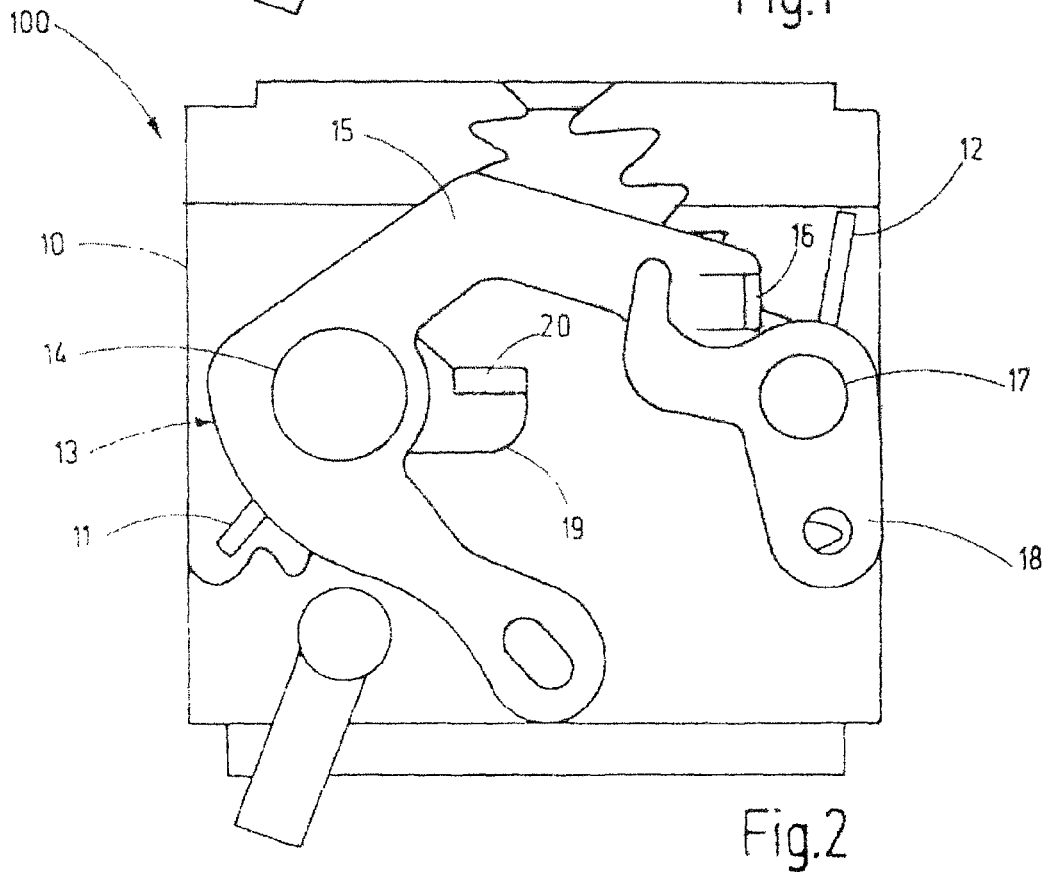
Figure 3:
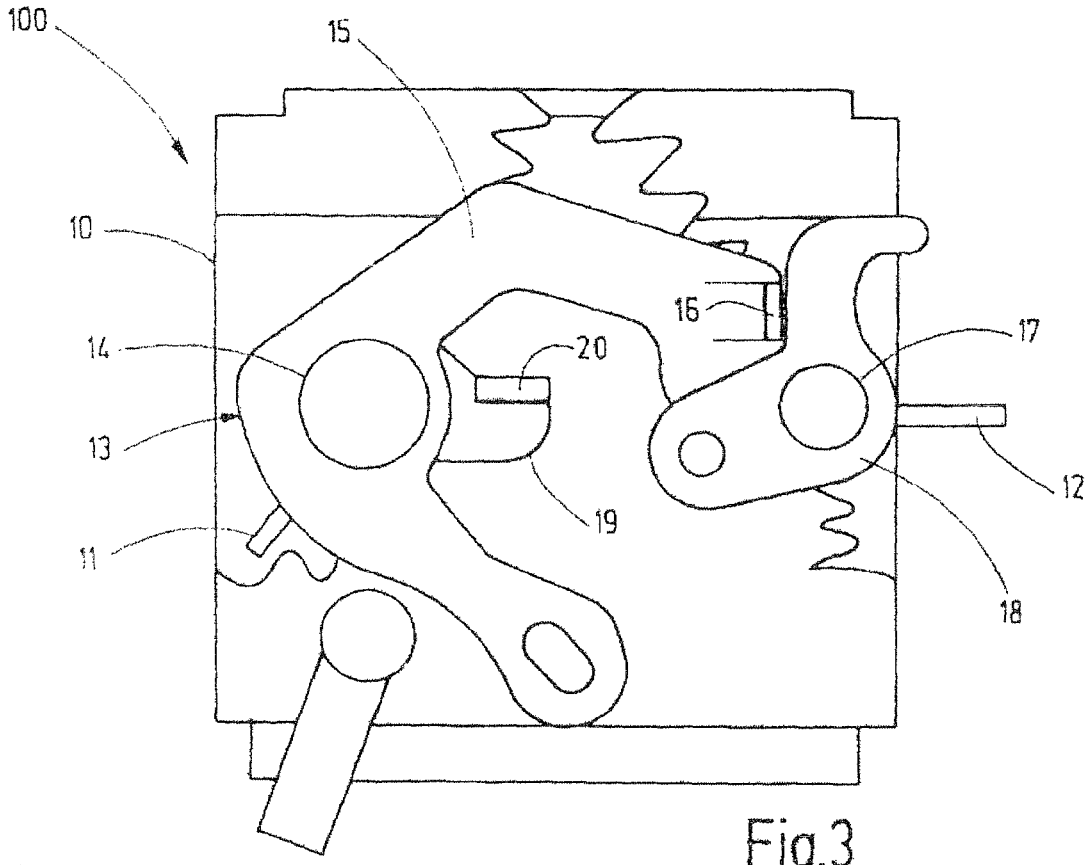
Figure 4:
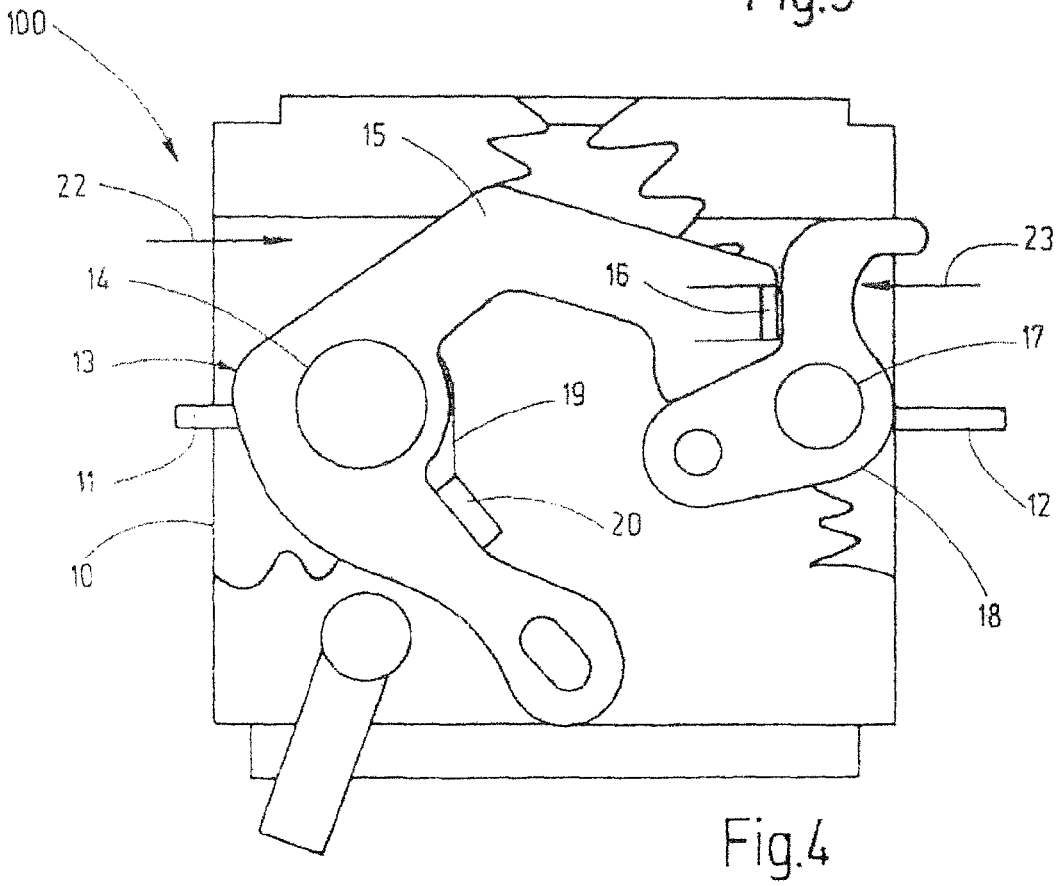
Figure 5:
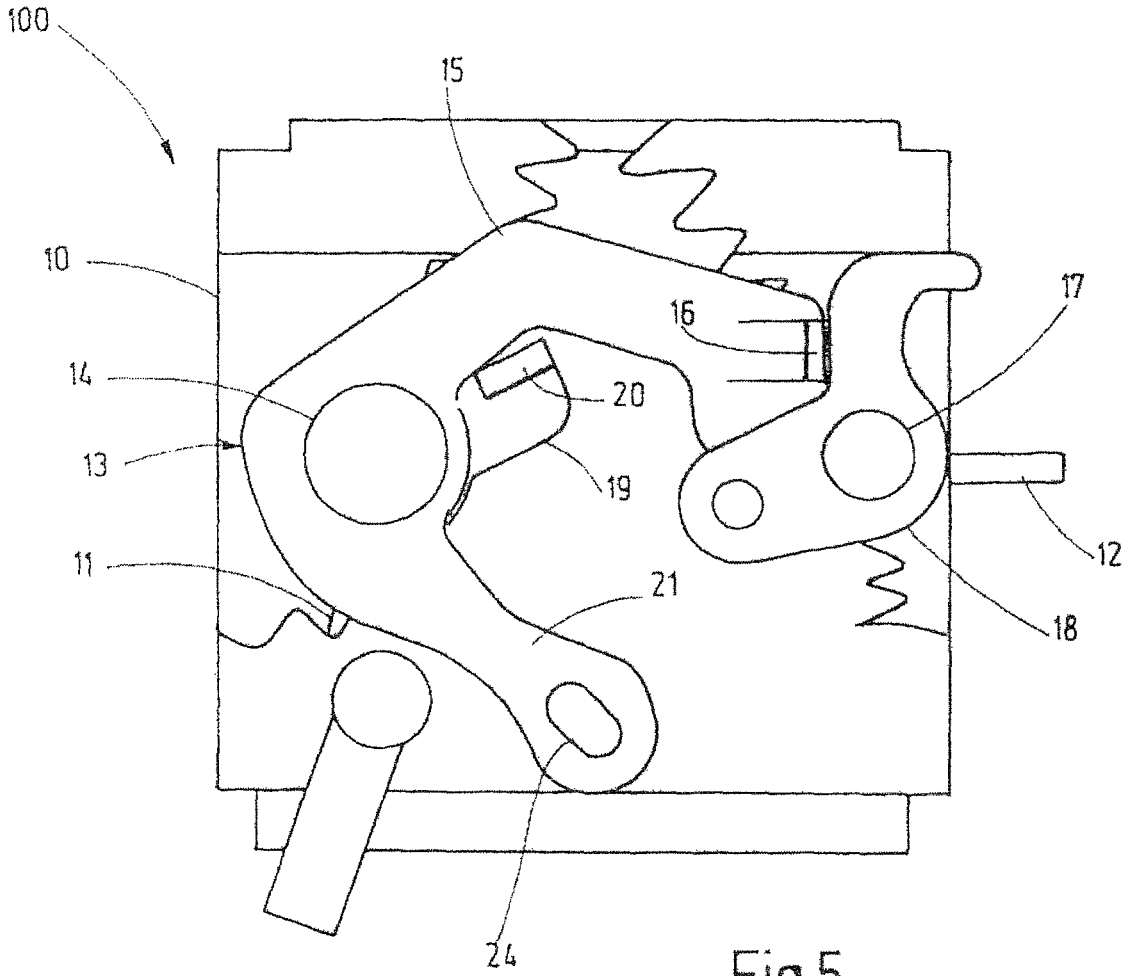

Further steps improving the invention are illustrated in further detail below together with the description of a preferred example embodiment of the invention with the aid of the figures, showing in purely diagrammatic representation:

FIG. 1 a side view of the carburettor unit for motorized equipment with the arrangement of the locking element between the choke valve lever and the throttle valve lever, with the carburettor unit shown in the OFF position, FIG. 2 a view of the carburettor unit according to FIG. 1, with the "cold start" position being shown, FIG. 3 a view of the carburettor unit according to FIG. 1, with the "half gas" position being shown, FIG. 4 a view of the carburettor unit according to FIG. 1, with the "full gas" position being shown, and FIG. 5 a view of the carburettor unit according to FIG. 1, with the "idling" position being shown.

FIG. 1 shows a diagrammatic side view of a carburettor unit 100 for motorized equipment according to the present invention. The carburettor unit 100 has a housing 10, which is illustrated partially in a cut-out manner. Through the cut-outs, a throttle canal 22, illustrated by a flow arrow, and a choke canal 23, shown by a further flow arrow, are shown. The fuel preparation takes place via a fuel supply which opens out in the flow canal inside the carburettor unit 100. The opening of the fuel supply is arranged between the choke valve (12) and the throttle valve (11), with an underpressure being produced through flow constriction, in order to admix the fuel to the charge air.

For quantity control of the drawn-in charge air, both a throttle valve 11 and also a choke valve 12 are provided inside the housing 10. The throttle valve 11 is mounted rotatably about a throttle valve shaft 14 and the choke valve 12 about a choke valve shaft 17. The throttle valve 11 is shown in an almost closed position, with the choke valve 12 being illustrated in an open position. These positions of the valves 11 and 12 bring about an "OFF position" of the carburettor unit 100.

A throttle valve lever 19 is connected so as to be locked against relative rotation with the throttle valve 11 on the throttle valve shaft 14, with a choke valve lever 18 being connected with the choke valve 12 so as to be locked against relative rotation on the choke valve shaft 17. In addition, a locking element 13 is held rotatably on the throttle valve shaft 14, with the throttle valve lever 19, the choke valve lever 18 and the locking element 13 being situated on the exterior of the housing 10 of the carburettor unit 100. The throttle valve lever 19, held on the throttle valve shaft 14 so as to be locked against relative rotation with the throttle valve 11, has an actuating angle 20 which extends into the extension plane of the locking element 13. The actuating angle 20 can be formed as an angled sheet metal region of the locking element 13 which is produced from a sheet metal material. By a rotation of the throttle valve lever 19 about the throttle valve shaft 14, the actuating angle 20 can abut both against a first section of the locking element 13, designated as actuating arm 15, and also against a further region of the locking element 13, designated as restoring arm 21. Consequently, as a function of the rotation position of the throttle valve 11, the locking element 13 can be turned about the throttle valve shaft 14.

The locking element 13 additionally has an actuating angle 16 at the end of the actuating arm 15. As a function of the rotation position of the locking element 13 about the throttle valve shaft 14, the actuating angle 16 of the locking element 13 can project into the swivel range of the choke valve lever 18, so that a rotation of the choke valve 12 about the choke valve shaft 17 is prevented. The illustrated position of the throttle valve 11 and of the choke valve 12 is an OFF position, so that the choke valve 12 is fully open and lies in the flow longitudinal direction inside the choke canal 23. Inside the housing 10 of the carburettor unit 100, a throttle valve stop screw can be provided, which is adjustable such that the throttle valve 11 in the idling position which is shown brings about an only very small effective flow cross-section inside the throttle canal 22.

FIG. 2 shows the carburettor unit 100 in the cold start position, wherein the choke valve shaft 17 with the choke valve 12 has been turned through approx. 75° anticlockwise. The choke valve 12 is therefore shown in a closed position. With the rotation of the choke valve 12, at the same time a rotation takes place of the choke valve lever 18 into the position which is shown. At the same time, either the conventional or the automatic half-gas of the throttle valve 11 is set. This is slightly open compared with the OFF position shown in FIG. 1. The locking lever 13 has a rotation position shown around the throttle valve shaft 14, so that the actuating arm 15 with the actuating angle 16 has no influence on the choke valve lever 18. In addition, the rotation position of the throttle valve 11 about the throttle valve shaft 14 has a rotation position in which the throttle valve lever 19 with the actuating angle 20 does not act on the locking element 13.

FIG. 3 shows the carburettor unit 100 in the half-gas position. For this, the throttle valve 11 is set into the half-gas position for a starting process, for which the throttle valve shaft 14 was swung through approximately 20° clockwise. The choke valve shaft 17 was turned through approximately 75° clockwise, whereby the choke valve 12 was opened. The locking element 13 is in fact already swung into the locking position, owing to the embodiment of the locking element 13, however, the choke valve 12 is rotatable into this position and not locked. Consequently, with the conventional half-gas it must be started in the sequence that firstly the choke valve 12 is closed and only following thereafter is the half-gas engaged.

FIG. 4 shows the carburettor unit 100 in a full gas position. For this, both the throttle valve 11 and also the choke valve 12 are fully opened, so that they lie respectively in the direction of flow inside the throttle canal 22 and the choke canal 23. The choke valve lever 18 is locked in its illustrated position by the actuating angle 16 on the actuating arm 15 of the locking element 13. The throttle valve lever 19 has moved through approximately 75° clockwise with respect to the closed position in the OFF position, so that thereby the locking element 13 has been brought by the stop of the actuating angle 20 on the throttle valve lever 19 into the locking position.

FIG. 5 finally shows the idling position of the carburettor unit 100. The choke valve 12 is fully opened, with the throttle valve 11 being almost closed. The choke valve lever 18 continues to be closed by the actuating angle 16 on the actuating arm 15 of the locking element 13, so that with a renewed transfer of the motorized equipment into the full gas position, the choke valve 12 can not be deliberately or inadvertently closed. When the motorized equipment is switched off by "ignition off", the locking element 13 is turned via an articulation rod again anticlockwise via the restoring arm 21, in order to cancel the locking. Thereby, the locking of the choke valve 12 is cancelled. Thereafter, the motor is switched off and the choke valve can be closed again for a renewed cold start. Through the elongated hole 24 inside the restoring arm 21, this can be positioned by the throttle valve lever 19, with the articulation rod being arranged between the restoring arm 21 and an OFF switch of the motorized equipment. The articulation rod is not moved through the elongated hole 24 when the locking element 13 is articulated through the throttle valve lever 19. The articulation rod for switching off the motor and for "unlocking" the locking element (13) is guided in the elongated hole (24). Both the articulation rod for switching off and also the articulation element for closing the choke valve are preferably integrated in a multi-function switch. In order to avoid an undesired retroaction on closing of the choke valve, the elongated hole is therefore provided in the locking element. Thereby, on closing of the choke valve, the "switch off articulation element" can slide without effect in the elongated hole.

The invention is not restricted in its embodiment to the preferred example embodiment indicated above. Rather, a number of variants are conceivable, which make use of the illustrated solution also with basically differently developed embodiments. All the features and/or advantages arising from the claims, the description or the drawings, including structural details, spatial arrangements and method steps, can be essential for the invention both alone and also in the most varied of combinations. In particular, the locking element 13 can also be arranged inside the carburettor unit 100. In addition, the development of the actuating angle 20 for the articulation of the locking element 13 and the actuating angle 16 for the locking of the choke valve lever 18 can be embodied differently, for example as detent stages on the throttle valve shaft 14. Furthermore, the actuating angle 20 can be embodied in the form of a cylinder pin inside the throttle valve lever 19, which runs in a gate which is arranged inside the locking element 13.

List of Reference Numbers

100 carburettor unit
10 housing
11 throttle valve
12 choke valve
13 locking element
14 throttle valve shaft
15 actuating arm
16 actuating angle
17 choke valve shaft
18 choke valve lever
19 throttle valve lever
20 actuating angle
21 restoring arm
22 throttle canal
23 choke canal
24 elongated hole

The invention claimed is:

1. Carburettor unit for motorized equipment having:

a housing that includes:

a throttle valve which is mounted rotatably about a throttle valve shaft;

a choke valve, the throttle valve and the choke valve being movable respectively between a closed position and an open position;

a locking element that is adjustable by moving the throttle valve and cooperates with the choke valve such that a movement of the choke valve into the closed position is blocked when the motorized equipment is set in operation and which is held rotatably on the throttle valve shaft;

a throttle valve lever is connected so as to be blocked against relative rotation with the throttle valve on the throttle valve shaft;

the throttle valve lever has an actuating angle which extends into the extension plane of the locking element, wherein by a rotation of the throttle valve lever about the throttle valve shaft, the actuating angle can abut both against an actuating arm of the locking element and against a restoring arm of the locking element, and the locking element has an actuating angle of the end of the actuating arm wherein as a function of the rotation position of the locking element about the throttle valve shaft, the actuating angle of the locking element can project into a swivel range of a choke lever, so that a rotation of the choke valve about a choke valve shaft is prevented.

2. Carburettor unit according to claim 1, wherein the locking element is produced from a sheet metal material and in particular by stamping/bending methods and extends in a main sheet metal plane.

3. Carburettor unit according to claim 2, wherein the actuating angle of the locking element projects out from the main sheet metal plane, via which the locking element cooperates in a locking manner with the choke valve.

4. Carburettor unit according to claim 1, wherein the locking element in the operation of the motorized equipment has a rotation position in which the actuating angle is swung into the rotation range of the choke valve lever such that a rotary movement of the choke valve from the open position into the closed position is prevented.

5. Carburettor unit according to claim 1, wherein the throttle valve and the throttle valve lever form an angle in relation to the shared rotation axis about the throttle valve shaft which is determined such that the throttle valve lever turns the locking element into the position locking the choke valve when the throttle valve is turned in the direction towards the open position.

6. Carburettor unit according to claim 1, wherein the choke valve and the choke valve lever form an angle in relation to the shared rotation axis about the choke valve shaft which is determined such that the choke valve lever is locked by the locking element when the choke valve is turned in the direction towards the open position.

7. Carburettor unit according to claim 1, wherein an articulation element is provided, by which the locking element is able to be swivelled again into a position releasing the choke valve when the motorized equipment is switched off.

* * * * *